US005920605A

United States Patent [19]

Lu

[11] Patent Number: 5,920,605

[45] Date of Patent: Jul. 6, 1999

[54] CATHODE CUP ASSEMBLY FOR AN X-RAY TUBE

[75] Inventor: Quan Ngoc Lu, Milwaukee, Wis.

[73] Assignee: General Electric Company, Milwaukee, Wis.

[21] Appl. No.: 08/729,054

[22] Filed: Oct. 10, 1996

[51] Int. Cl.[6] ..... H01J 35/06

[52] U.S. Cl. ..... 378/136; 378/119

[58] Field of Search ..... 378/136

[56] References Cited

U.S. PATENT DOCUMENTS

| | | | |
|---|---|---|---|
| 3,943,393 | 3/1976 | Naill | 378/136 |
| 4,825,123 | 4/1989 | Franzel et al. | 378/136 |
| 5,526,396 | 6/1996 | Jacob | 378/136 |

*Primary Examiner*—Craig E. Church

*Attorney, Agent, or Firm*—John S. Beulick; Christian G. Cabou; Phyllis Y. Price

[57] ABSTRACT

Cathode cup assemblies for an x-ray tube are described. In one embodiment, the cathode cup assembly includes a cathode cup, and a cathode insulator assembly. The cathode insulator assembly includes a filament lead tube, an insulator, and a nickel eyelet. The filament lead tube is inserted within the ceramic insulator so that a portion of the tube extends from the insulator. The nickel eyelet is brazed at a first end to the insulator. An outer surface of the nickel eyelet is brazed to the cathode cup to secure the cathode insulator assembly to the cathode cup. The brazed nickel eyelet enables filament leads to be positioned at a filament set height with respect to the cathode cup.

19 Claims, 2 Drawing Sheets

CATHODE CUP ASSEMBLY FOR AN X-RAY TUBE

FIELD OF THE INVENTION

This invention relates generally to x-ray tubes used in medical imaging and more particularly, to cathode insulator assemblies for use in such x-ray tubes.

BACKGROUND OF THE INVENTION

An x-ray source used in medical imaging systems, such as computed tomography systems, typically includes an evacuated x-ray envelope containing an anode and a cathode. X-rays are produced by applying a high voltage across the anode and cathode and accelerating electrons from the cathode against a focal spot on the anode. The x-rays diverge from the focal spot in a generally conical pattern.

Known cathode assemblies for such x-ray sources typically include a cathode cup, a cathode insulator, and several current carrying filaments. Each filament includes a coil and leads extending from respective ends of the coils. The cathode cup has a filament receiving portion for the filaments, and lead openings extend through the cup to the filament receiving portion. Cathode insulators are connected to the cathode cup, and the filament leads extend through respective lead openings and insulators to an energy source.

At least one known cathode insulator includes a hollow filament lead tube, a substantially cylindrical insulating member, and a nickel flange. A bore extends through the cylindrical insulating member and the filament is located in the insulating member bore. Particularly, the filament lead tube is positioned within the insulating member bore and is brazed to the insulating member so that the axis of the tube is coaxial with the axis of the insulating member. The tube extends from one end of the insulating member. The flange is brazed to an outer surface of the insulating member, and has a flange portion which extends radially outwardly from the insulating member outer surface.

To form the cathode assembly, the cathode insulator is spot welded to the cathode cup, and filaments are inserted into the cathode cup so that each filament coil rests in the filament receiving portion and each filament lead extends through a respective lead opening and cathode insulator. Particularly, and for each lead opening, the flange portion of the flange of an insulator is spot welded to the cathode cup so that the insulating member bore and filament lead tube are aligned with the respective lead opening. Filaments are then inserted into the cathode cup so that the filament leads extend through the lead openings and cathode insulators to a specific filament set height.

Precise positioning of the filaments is important because such positioning affects operation characteristics of the x-ray tube, such as focal spot size and position. Incorrect focal spot position causes image resolution loss and image degradation. Accordingly, it is desirable to properly position each filament lead, and particularly the filament coils, within the cathode cup.

To facilitate proper filament positioning, each filament lead, after being set to a predetermined filament set height, is flashed to its respective cathode insulator filament lead tube. The spot welding and flashing processes facilitate ensuring that each filament is positioned for correct focal spot positioning.

The welding and flashing processes described above, however, are time consuming and cumbersome. For example, flanges from adjacent cathode insulators often overlap, inhibiting satisfactory welding. Therefore, the flanges must often be trimmed before they are welded to the cathode cup. Trimming the flanges is a time consuming and tedious task. Furthermore, the welds between the respective flanges and the cathode cup may loosen during the flashing process and tube operation, causing the respective cathode insulators to move relative to the cathode cup. Such movement requires readjusting the filament, and re-flashing, and re-working the filament leads.

It would be desirable to eliminate flange trimming when attaching a cathode insulator to a cathode cup. It also would be desirable to eliminate the time consuming welding process and minimize the time consuming and costly process of repositioning, re-flashing, and re-working filaments within a cathode cup. Eliminating such processes, however, preferably would not result in any less precise positioning of the filament coils in the cathode cup.

SUMMARY OF THE INVENTION

These and other objects may be attained in a cathode insulator assembly which, in one embodiment, includes a filament lead tube, an insulator, and an eyelet. The insulator is substantially cylindrical and has a first end, a second end, and a bore extending coaxially therethrough from the first end to the second end. The filament lead tube is located in the insulator bore and extends from the first end of the insulator. The eyelet is secured at a first end to the insulator, and an outer surface of the eyelet is configured to be secured to a cathode cup.

In one configuration, the outer surface of the eyelet is brazed to the cathode cup so that the insulator bore and the filament lead tube are aligned with a respective filament lead opening of the cathode cup. Once cathode insulator assemblies are secured to the cup at each filament opening as described above, filaments are inserted into the cathode cup so that each filament coil rests within a filament receiving portion of the cathode cup and the filament leads extend through respective filament lead openings and cathode insulator assemblies. The filament leads are then flashed to respective filament lead tubes.

The above described cathode insulator assembly eliminates the time consuming and cumbersome process of flange trimming, and also eliminates the spot welding process. In addition, such insulator assembly minimizes the time consuming and costly process of repositioning, re-flashing, and re-working filaments within the cathode cup. The cathode insulator assembly also enables precise positioning of filament coils within the cathode cup.

DETAILED DESCRIPTION OF THE DRAWINGS

Figure 1:
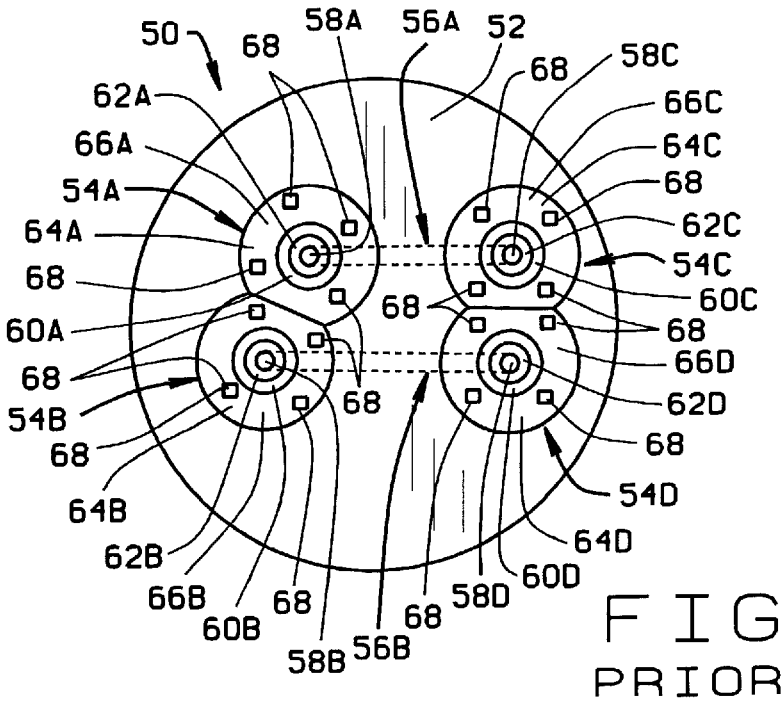
FIG. 1 PRIOR ART
FIG. 1 is a plan view of a known cathode insulator and cup.

FIG. 1 is a plan view of a known cathode cup assembly 50 including a cathode cup 52, four cathode insulators 54A, 54B, 54C, and 54D, and two filaments 56A and 56B (shown in phantom). Filaments 56A and 56B each include a filament coil (not shown) and leads 58A, 58B, 58C, and 58D extending from respective ends of the filament coils.

Cathode insulators 54A, 54B, 54C, and 54D each include a respective insulating member 60A, 60B, 60C, and 60D, a respective filament lead tube 62A, 62B, 62C, and 62D and a respective flange 64A, 64B, 64C, and 64D. Insulating members 60A, 60B, 60C, and 60D each have a bore (not shown in FIG. 1) therein, and filament lead tubes 62A, 62B, 62C, and 62D are inserted within the respective bores and brazed to respective insulating members 60A, 60B, 60C, and 60D. Similarly, each flange 64A, 64B, 64C, and 64D has an aperture (not shown) sized so that respective insulating members 60A, 60B, 60C, and 60D can extend therethrough. Flanges 64A, 64B, 64C, and 64D are then brazed to respective insulating members 60A, 60B, 60C, and 60D so that flange portions 66A, 66B, 66C, and 66D extend radially outwardly from respective insulating members 60A, 60B, 60C, and 60D.

To secure cathode insulators 54A, 54B, 54C, and 54D to cathode cup 52, flanges 64A, 64B, 64C, and 64D are spot welded to cathode cup 52 at spot welds 68. Prior to spot welding, however, flanges 64A, 64B, 64C, and 64D must be trimmed so that such flanges 64A, 64B, 64C, and 64D do not overlap. If such flanges 64A, 64B, 64C, and 64D were to overlap, then it would be very difficult to securely spot weld each flange 64A, 64B, 64C, and 64D to cathode cup 52. Trimming flanges 64A, 64B, 64C, and 64D, however, often is time consuming and cumbersome.

Figure 2:
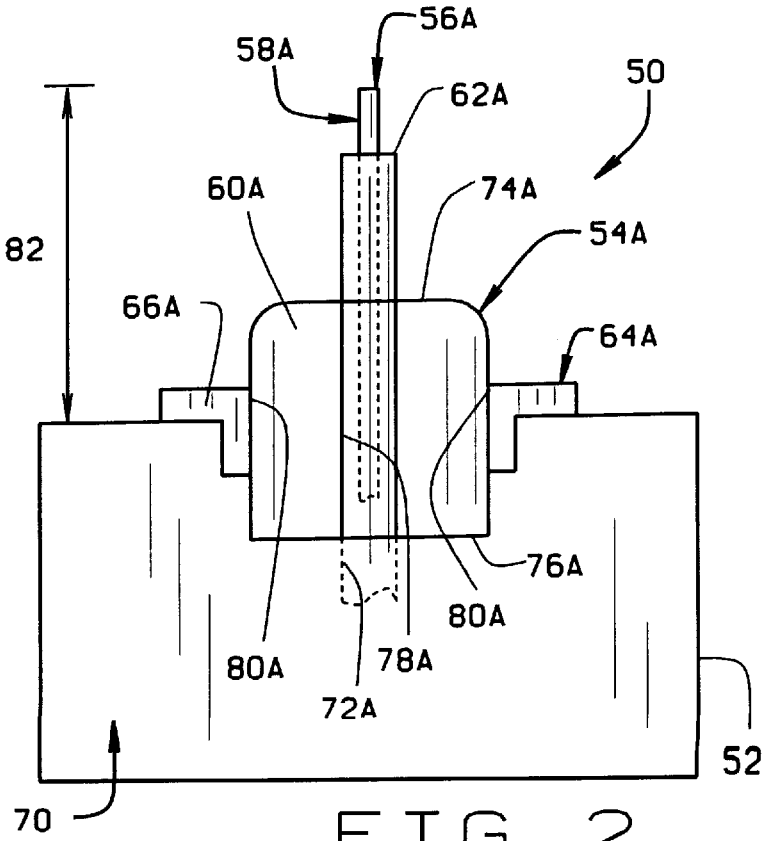
FIG. 2 PRIOR ART
FIG. 2 is a side elevation partial cross-section view of the cathode insulator and cup of FIG. 1.

FIG. 2 illustrates a side elevation partial cross-section view of cathode assembly 50. Particularly, filament 56A includes a filament coil (not shown) and leads 58A and 58C (only lead 58A is visible in FIG. 2) extending from respective ends of the filament coil. Cathode cup 52 includes a filament receiving portion 70 and a filament lead opening 72A which extends through cathode cup 52 to filament receiving portion 70.

Insulating member 60A of cathode insulator 54A includes a first end 74A and a second end 76A, with bore 78A extending from first end 74A to second end 76A. Filament lead tube 62A is inserted within bore 78A, and filament lead tube 62A extends from first end 74A of insulating member 60A. Filament lead tube 62A is brazed to insulating member 60A. Flange 64A is brazed to insulating member 60A so that portion 66A of flange 64A protrudes radially outward from insulating member 60A. More particularly, a surface of flange 64A at a periphery of a flange aperture 80A is brazed to insulating member 60A so that flange portion 66A extends radially outward from insulating member 60A. Cathode insulator 54A is connected to cathode cup 52 so that insulating member bore 78A and filament lead tube 62A are aligned with filament lead opening 72A. Particularly, portion 66A of flange 64A is spot welded to cathode cup 52.

Filament 56A is inserted in cathode cup 52 so that the filament coil rests within filament receiving portion 70 and filament lead 58A extends through filament lead opening 72A, insulating member bore 74A, and filament lead tube 62A. Filament lead 58A extends from filament lead tube 62A so that filament lead 58A is a specific distance 82 from cathode cup 52 to ensure proper filament coil positioning within cathode cup 52. The specific distance 82 is also referred to herein as filament set height. Filament lead 58A is then connected, or flashed, to filament lead tube 62A. An identical process is carried out for other filament leads 58A, 58C and 58D (FIG. 1).

As is known, spot welds 68 may become loose when cathode cup assembly 50 is subjected to high temperatures. More particularly, during filament flashing or tube operation, spot welds 68 may loosen. If spot welds 68 loosen, insulating members 60A, 60B, 60C, and 60D, may move relative to cathode cup 52, causing respective filament leads 58A, 58B, 58C and 58D to move. Such movement requires re-welding, re-flashing, and re-working to properly position filament leads 58A, 58B, 58C, and 58D. Of course, re-welding and re-flashing are undesirable because such processes increase the time and cost associated with making an x-ray source.

In accordance with one embodiment of the present invention, an insulator assembly is secured to a cathode cup without any flange trimming. Furthermore, the insulator assembly is secured to the cathode cup so that it is movable with respect to the cathode cup. Therefore, if any filament adjustment is desired after flashing the filament, the insulator assembly may be moved, rather than re-flashing the filament.

Figure 3:
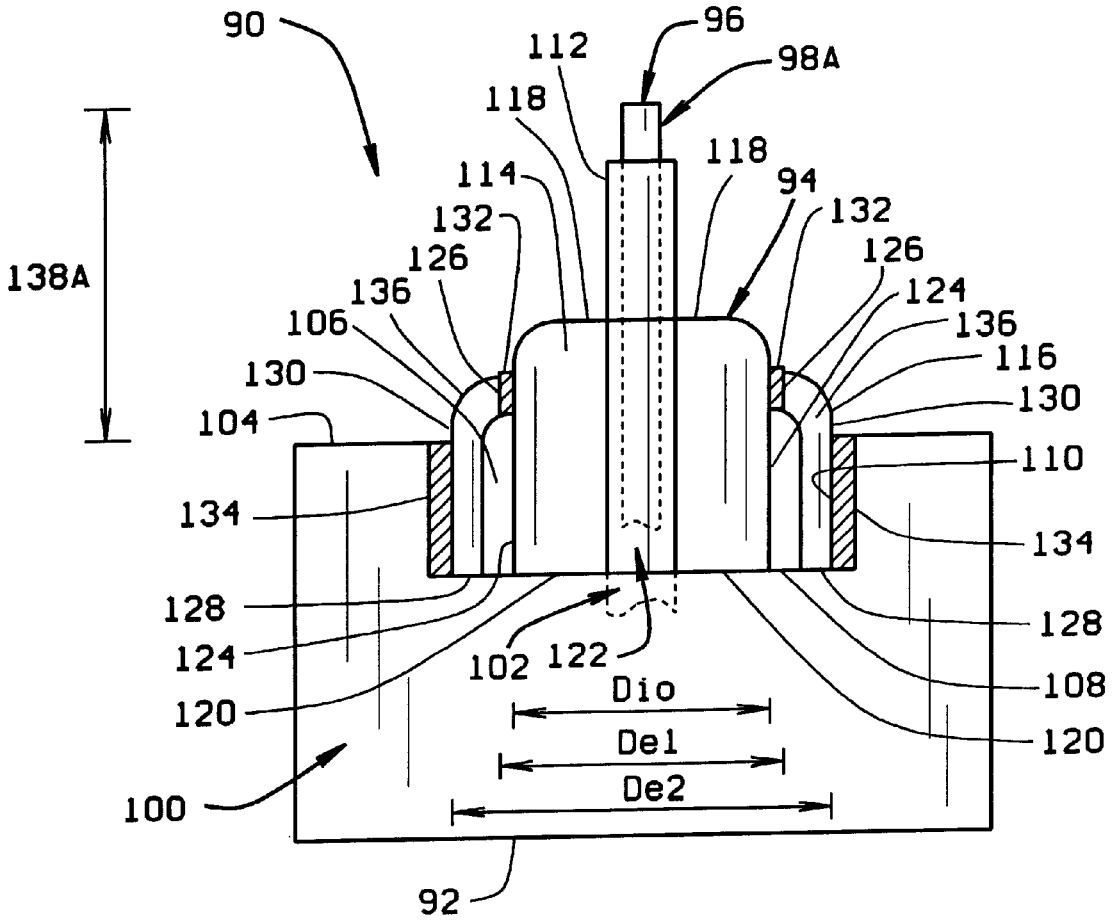
FIG. 3 is a side elevation partial cross-section view of a cathode cup assembly in accordance with one embodiment of the present invention.

FIG. 3 illustrates a side elevation partial cross-section view of a cathode cup assembly 90 in accordance with one embodiment of the present invention. Specifically, cathode cup assembly 90 includes a cathode cup 92, a cathode insulator assembly 94, and a filament 96. Filament 96 includes a filament coil (not shown) and filament leads 98A and 98B (only filament lead 98A is shown in FIG. 3) extending from respective ends of the filament coil. Cathode cup 92 includes a filament coil receiving portion 100 and filament lead openings 102 which extend through cathode cup 92 to filament coil receiving portion 100. Cathode cup 92 also includes a cup surface 104 having an insulator cavity 106 therein. Insulator cavity 106, as shown, is defined by an insulator connecting surface 108 and a sidewall surface 110 extending from insulator connecting surface 108 to cup surface 104. Insulator cavity 106 is sized to receive cathode insulator assembly 94 therein.

Cathode insulator assembly 94 includes a substantially cylindrical and hollow filament lead tube 112, a substantially cylindrical insulator 114 and an eyelet 116. Insulator 114 has a first end 118, a second end 120, and a bore 122 extending from first end 118 to second end 120. Insulator second end 120 has an outer surface 124 with an outer diameter $D_{io}$. Filament lead tube 112 is inserted within bore 122, and filament lead tube 112 extends from first end 118 of insulator 114. Particularly, tube 112 is brazed to insulator 114. However, filament lead tube 112 may be secured to insulator 114 by other known means.

Eyelet 116 has a first end 126, a second end 128 and an outer surface 130 between ends 126 and 128. Eyelet first end 126 and second end 128 have respective inner diameters $D_{e1}$ and $D_{e2}$. Eyelet first end 126 is configured to be secured to insulator 114, and eyelet outer surface 130 is configured to be secured to cathode cup 92. As shown, both inner diameter $D_{e1}$ of eyelet first end 126 and inner diameter $D_{e2}$ of eyelet second end 128 are greater than outer diameter $D_{io}$ of insulator second end 120. Similarly, inner diameter $D_{e2}$ of eyelet second end 128 is greater than inner diameter $D_{e1}$ of eyelet first end 126.

To assemble filament lead tube 112, insulator 114 and eyelet 116, filament lead tube 112 is inserted at least partially into bore 122 of insulator 114, and brazed to insulator 114 to secure filament lead tube 112 to insulator 114. Similarly, first end 126 of eyelet 116 is brazed to insulator 114 to secure insulator 114 to first end 126 of eyelet 116. Particularly, first end 126 of eyelet 116 is brazed to outer surface 122 of insulator 114 with a copper braze 132.

To assemble cathode cup 92, cathode insulator assembly 94, and filament 96, cathode insulator assembly 94 is positioned within cathode cup 92 so that insulator bore 122 and filament lead tube 112 are aligned with lead opening 102 of cathode cup 92. Outer surface 130 of eyelet 116 is then secured to cathode cup 92. More particularly, cathode insulator assembly 94 is inserted into insulator cavity 106 so that insulator second end 128 is adjacent insulator connecting surface 108 of cathode cup 92, and eyelet outer surface 130 is adjacent cavity sidewall surface 110 of cathode cup 92. Eyelet outer surface 130 is then brazed, with a copper braze 134, to cavity sidewall surface 110. However, and as shown, a portion 136 of eyelet 116 is neither brazed to cavity sidewall surface 110 nor insulator 114.

Filament 96 is then inserted into cathode cup 92 so that the filament coil rests within cathode cup 92, and filament lead 98A extends through lead opening 102, insulator bore 122 and filament lead tube 112 to a filament set height 138A. Filament lead 98A is then flashed to filament lead tube 112. The other filament leads are secured to cathode cup 92 in a manner identical to the manner in which filament lead 98A is secured, as described above.

In the event that further adjustment of a filament is required after flashing the leads to respective insulator assemblies, such adjustment can be made quickly and easily. Specifically, eyelet 116 has sufficient flexibility permitting insulator assembly 94 to move relative to cathode cup 92, even after insulator assembly 94 is brazed to cathode cup 92. Eyelet portion 136 may be stretched without weakening brazes 132 or 134. Insulator 114, thus, may be gripped and moved relative to cathode cup 92 without weakening brazes 132 or 134.

In one embodiment, insulator 114 is ceramic, brazes 132 and 134 are copper brazes, eyelet 116 is nickel, and filament lead tube 112 is Kovar material. Of course, many other materials can be used for such components.

Cathode cup assembly 90 does not require time consuming and cumbersome trimming and welding processes. In addition, insulator assembly 94 permits adjustment of filament leads after flashing. Further, filament coils can be precisely positioned within cathode cup 92.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. For example, cathode cup assembly 90 is described herein with respect to one filament. However, the cathode cup assembly can have any number of filaments. Accordingly, the spirit and scope of the invention are to be limited only by the terms of the appended claims.

What is claimed is:

1. A cathode insulator assembly for a cathode cup of an x-ray tube, said cathode insulator assembly comprising:

a substantially cylindrical filament lead tube;

a substantially cylindrical ceramic insulator having a first end and a second end, and a bore extending through said insulator from said first end to said second end, said filament lead tube extending into said bore and extending from said insulator first end; and an eyelet having a first end and a second end and an outer surface between said first and second ends, said eyelet first end secured to said insulator, said eyelet second end having an inner diameter greater than an inner diameter of said eyelet first end, and said eyelet outer surface for securing said eyelet to the cathode cup.

2. An assembly in accordance with claim 1 wherein said filament lead tube is brazed to said insulator.

3. An assembly in accordance with claim 1 wherein said eyelet first end is brazed to said insulator.

4. An assembly in accordance with claim 3 wherein said braze is a copper braze.

5. An assembly in accordance with claim 1 wherein said filament lead tube is Kovar.

6. An assembly in accordance with claim 1 wherein said eyelet is nickel.

7. An assembly in accordance with claim 1 wherein said eyelet first end has an inner diameter, and said eyelet first end inner diameter is greater than said insulator second end outer diameter.

8. An assembly in accordance with claim 1 wherein said eyelet further includes an middle portion, said middle portion being positioned above said cathode cup and away from said insulator.

9. A method for assembling a cathode cup, a filament, and a cathode insulator assembly, the cathode cup including a filament coil receiving portion and filament lead openings which extend through the cathode cup to the filament coil receiving portion, the cathode insulator assembly including a filament lead tube, an insulator having a first end, a second end, a bore extending from the first end to the second end, and an eyelet having a first end with an inner diameter, a second end with an inner diameter and an outer surface between the first and second ends, the second end inner diameter being larger than the first end inner diameter, said method comprising the steps of:

inserting the filament lead tube at least partially into the bore of the insulator;

securing the filament lead tube to the insulator;

securing the first end of the eyelet to the insulator; and securing the outer surface of the eyelet to the cathode cup.

10. A method in accordance with claim 9 wherein securing the insulator to the first end of the eyelet comprises the step of brazing the insulator to the first end of the eyelet.

11. A method in accordance with claim 9 wherein securing the outer surface of the eyelet to the cathode cup comprises the step of brazing the second end of the eyelet to the cup.

12. A method in accordance with claim 9 wherein the filament includes a first filament lead, a second filament lead, and a filament coil extending between the first and second filament leads, said method further comprising the steps of:

inserting one of the filament leads through the bore of the insulator and the filament lead tube; and flashing the extended filament lead to the filament lead tube.

13. A cathode insulator assembly for a cathode cup of an x-ray tube, said cathode insulator assembly comprising:

a substantially cylindrical filament lead tube;

a substantially cylindrical ceramic insulator having a first end and a second end, and a bore extending through said insulator from said first end to said second end, said filament lead tube extending into said bore and extending from said insulator first end; and an eyelet having a first end, a second end, a middle portion, and an outer surface extending between said first and second ends, said eyelet first end secured to said insulator, said middle portion of said eyelet extending from said cathode cup and said eyelet outer surface for securing said eyelet to the cathode cup.

14. An assembly in accordance with claim 13 wherein said eyelet first end has an inner diameter, and said eyelet first end inner diameter is greater than said insulator second end outer diameter.

15. An assembly in accordance with claim 13 wherein said eyelet first and second ends each include an inner diameter, said eyelet second end inner diameter greater that said eyelet first end inner diameter.

16. An assembly in accordance with claim 13 wherein said filament lead tube is brazed to said insulator.

17. An assembly in accordance with claim 13 wherein said eyelet first end is brazed to said insulator, said braze is a copper braze.

18. An assembly in accordance with claim 13 wherein said filament lead tube is Kovar.

19. An assembly in accordance with claim 13 wherein said eyelet is nickel.

* * * * *